US006900735B2

(12) United States Patent
Guerrieri et al.

(10) Patent No.: US 6,900,735 B2
(45) Date of Patent: May 31, 2005

(54) MODULAR LIGHTING DEVICE AND ACTUATION SYSTEM

(75) Inventors: Salvatore Guerrieri, Garfield, NJ (US); Lawrence David Adelman, New York, NY (US)

(73) Assignee: Acolyte Systems Inc., New York, NY (US)

( * ) Notice: Subject to any disclaimer, the term of this patent is extended or adjusted under 35 U.S.C. 154(b) by 456 days.

(21) Appl. No.: 09/750,879

(22) Filed: Dec. 28, 2000

(65) Prior Publication Data

US 2002/0084890 A1 Jul. 4, 2002

(51) Int. Cl.[7] ..... G08B 5/00

(52) U.S. Cl. ..... 340/815.4; 340/908; 340/908.1; 340/321; 340/332; 362/153.1; 362/183; 362/184; 362/186; 362/187

(58) Field of Search ..... 340/815.4, 908, 340/908.1, 332, 321; 362/153.1, 183, 184, 186, 187

(56) References Cited

U.S. PATENT DOCUMENTS

| | | | | |
|---|---|---|---|---|
| 3,800,134 A | | 3/1974 | Cataldo | |
| 4,595,978 A | * | 6/1986 | Sheffield | 700/12 |
| 4,872,095 A | | 10/1989 | Dudak et al. | |
| 5,246,285 A | | 9/1993 | Redburn | |
| 5,839,816 A | * | 11/1998 | Varga et al. | 362/153.1 |
| 6,030,089 A | | 2/2000 | Parker | |

* cited by examiner

*Primary Examiner*—Daryl Pope
(74) *Attorney, Agent, or Firm*—Jonathan B. Schafrann

(57) ABSTRACT

An illumination device that is highly durable, wireless, programmable, inexpensive emits little to no heat, is shockproof, water-resistant, energy efficient, is multidirectional, responds to a multitude of stimulus and adapts for a multitude of purposes. The programmable device provides varying amounts of light in accordance with programmed instructions.

21 Claims, 4 Drawing Sheets

MODULAR LIGHTING DEVICE AND ACTUATION SYSTEM

FIELD OF THE INVENTION

The instant invention relates generally to lighting devices and more specifically to a small, modular, digital, solid-state lighting device and actuation systems.

BACKGROUND OF THE INVENTION

Since the age of candles and oil lamps numerous advances have been made in the area of portable illumination devices. By the late $19^{th}$ century, flashlights utilizing simple circuitry represented the next generation of illumination devices. Since the invention of flashlights, they have generally utilized a filament light bulb, an on/off switch and battery connected in an operative series. Such flashlights are generally well known within the art and for almost a century flashlight technology has generally remained unchanged.

There are a number of flashlights on the market that are well known in the art. Included in these are two AAA-cell powered Lights (Pen Light and Mini-Pocket Light), the MiniMityLite, Mitylite, the photon light and Super Mitylite. While these lights vary according to the design and colors, they all share similar components: a battery, a light and leads or wires connecting the battery to the light. An assembly in accordance with the state of the art is prone to premature battery drain.

While there are many flashlight-type devices, the art contains a relative few lighting devices that are linked with a non-traditional assemblage. Specifically, few personal lighting devices contain anything other than a tube holder, an incandescent bulb, wires leading to an on/off switch, a battery, a lens, and a reflector. Set out below, are some examples of lighting devices which may be termed non-traditional.

U.S. Pat. No. 4,872,095 issued to Dudak et al discloses an entrance door night light contained within an enclosure that is mounted to the head of an entrance doorway between the storm door and the entrance door. The enclosure contains a lamp, powered by a DC voltage source, a momentary switch that makes contact with the storm door and is used to switch the lamp on when the storm door is opened, a timer to turn the light off if the storm door does not close, and a photocell to keep the lamp off during daylight, even when the storm door is opened. Such systems use wires, which can fray, require added solder points, are susceptible to corrosion, are difficult to handle and time consuming to install.

U.S. Pat. No. 3,800,134 issued to Castaldo, discloses a handbag whose interior is illuminated through the use of a small lamp or bulb unit connected by an elongate flexible conductor to a switch unit that is in turn connected to a battery unit. The switch may function to turn on the lamp or bulb automatically, or may be manually switched on.

U.S. Pat. No. 5,246,285 issued to Redburn et al discloses a self-contained automatic lighting device for use in the interior of a container which is comprised of a backing plate, cover means, light sources and pivoting switch means. Also disclosed, the lighting device utilizes a photo-sensor to determine actuation and a timer to deactivate the light after a certain amount of time.

U.S. Pat. No. 6,030,089 issued to Parker et al, discloses a light distribution system for supplying light to an input edge of a light emitting portion for conduction within. Parker discloses that a system may be used in order to display information or logos and discloses the use of switches—e.g. a microprocessor to meet a particular application. Such systems are known in the art and generally utilize floating point arithmetic and "look-up" tables to perform mathematical equations within the programming logic. The general formula for a floating-point number x is:

$$x=s*MX*\beta\hat{}p$$

where "s" is the sign, Mx is the (normalized) mantissa, β is the base (also known as the radix), and p is an integer power. The representation of these numbers in a digital computer will restrict p to some range, for example [L, U] based on the number of exponent bits Ne, while the precision of the mantissa Mx is restricted to Nf (or Nf+1 if a "hidden" bit is used) bits. Many conventions for the choice of β and the normalization of Mx exist. Most computer systems today, other than IBM mainframes and their clones, use β=2. The normalization of the mantissa Mx is chosen to be 1.fffff (binary) for the IEEE standard, although you will find systems that use 0.1fffff (binary).

Since there are only a certain number of bits for the mantissa, the question arises of what to do with the bits that cannot be stored. It is generally accepted that there are two choices: discard them completely "chop" or round the stored part up or down based on whether the next bit is 1 or 0. For example, if we have 1.01010101 and need to store it so there are only 3 places after the binary (radix) point, chopping, in accordance with the prior art, gives 1.010 while rounding gives 1.011. Note that the IEEE standard uses rounding. This can cause vagaries and inaccuracies. Also, devices using floating point arithmetic logic when fixed point logic would suffice are less efficient, requiring more logic steps, greater power and are prone to problems. Thus, a need exists for an arithmetical logical unit that utilizes simpler instructions, and doesn't have the vagaries associated with floating point arithmetic and look-up tables. Such a logic unit requires fewer steps, encounters fewer problems and utilizes less power. This is particularly desirable when seeking an extended life illumination device such as that of the present invention.

Efforts at improving such flashlights have primarily addressed the quality of the optical characteristics and sought to reduce size. However, the present invention represents new and intelligent illumination devices. There has been a need for an extended life lighting device that is small, highly durable, inexpensive, wireless, shockproof, water-resistant, emits little to no heat, small, wireless, utilizes a multidirectional light, responds to a multitude of stimulus and adapts for a multitude of purposes through the use of a single compact device.

OBJECT OF THE INVENTION

Generally, prior art illumination devices respond to pressure on a mechanical on/off switch and are not capable of generating, receiving, storing or sending information. The present invention, though, is programmed to respond to a multitude of different stimuli and will react accordingly. This allows the present invention to adapt and be adapted for use within a hands free lighting system for: law enforcement, EMS (emergency medical services), household wireless lighting for installation in cabinets and drawers, safety and handheld lights, fishing, hunting and camping equipment, musical instrument and equipment cases, briefcases, knapsacks, accessories, cosmetic bags, footwear, cellular phones, wireless phones, fragrance bottles, liquor and spirit bottles, awards, music concert promotions, boating and other uses. The resulting device is a highly durable, inexpensive light which emits little to no heat, is shockproof, water-resistant, multidirectional, responds to a multitude of stimuli and is adaptable for a multitude of purposes.

It is a principal objective of the present invention to overcome the previously mentioned difficulties with an intelligent lighting device that is capable of utilizing a single programming chip with multi-level command structures that efficiently manages power.

Another object of the instant invention is that the lighting device is programmable with a variety of illumination features.

Still another object of the instant invention is that the device is water resistant, has an extended battery life, bulb life and obviates the vagaries of prior art system.

Yet another feature of the instant invention is that it may be actuated in reaction to stimuli or manually.

A further feature of the instant invention is to provide a lighting device which is modular, and it can stand alone or be incorporated into a further design.

SUMMARY OF THE INVENTION

More specifically, the lighting device in accordance with the instant invention utilizes a programmable chip means, such as a speech-type chip as defined herein, a push button switch means, a printed circuit board, a capacitor, battery holder, battery, multidirectional light, a plurality of jumpers, a diode and a resistor. The programmable chip means is programmed according to a desired set of logic, written in assembler, compiled to a binary file, then inputted or programmed onto the chip. The result is an illumination device that is capable of responding to a multitude of stimuli, such as a mechanical push button, magnetic fields, sound, light, radio waves, or other phase changing stimulus either alone or in combination. After receiving and interpreting the stimulus, the lighting device in accordance with the instant invention determines appropriate levels and periods of illumination. By using simple programming steps the illumination device is designed to utilize very little power. A power saving feature programmed herein is the ability for the device to maintain illumination for a specific period of time with the ability to reduce the power to a negligible threshold.

BRIEF DESCRIPTION OF THE DRAWINGS

These and other advantages of the present invention will be more fully understood by reference to the following detailed description in conjunction with the attached drawings in which.

DETAILED DESCRIPTION

Figure 1:
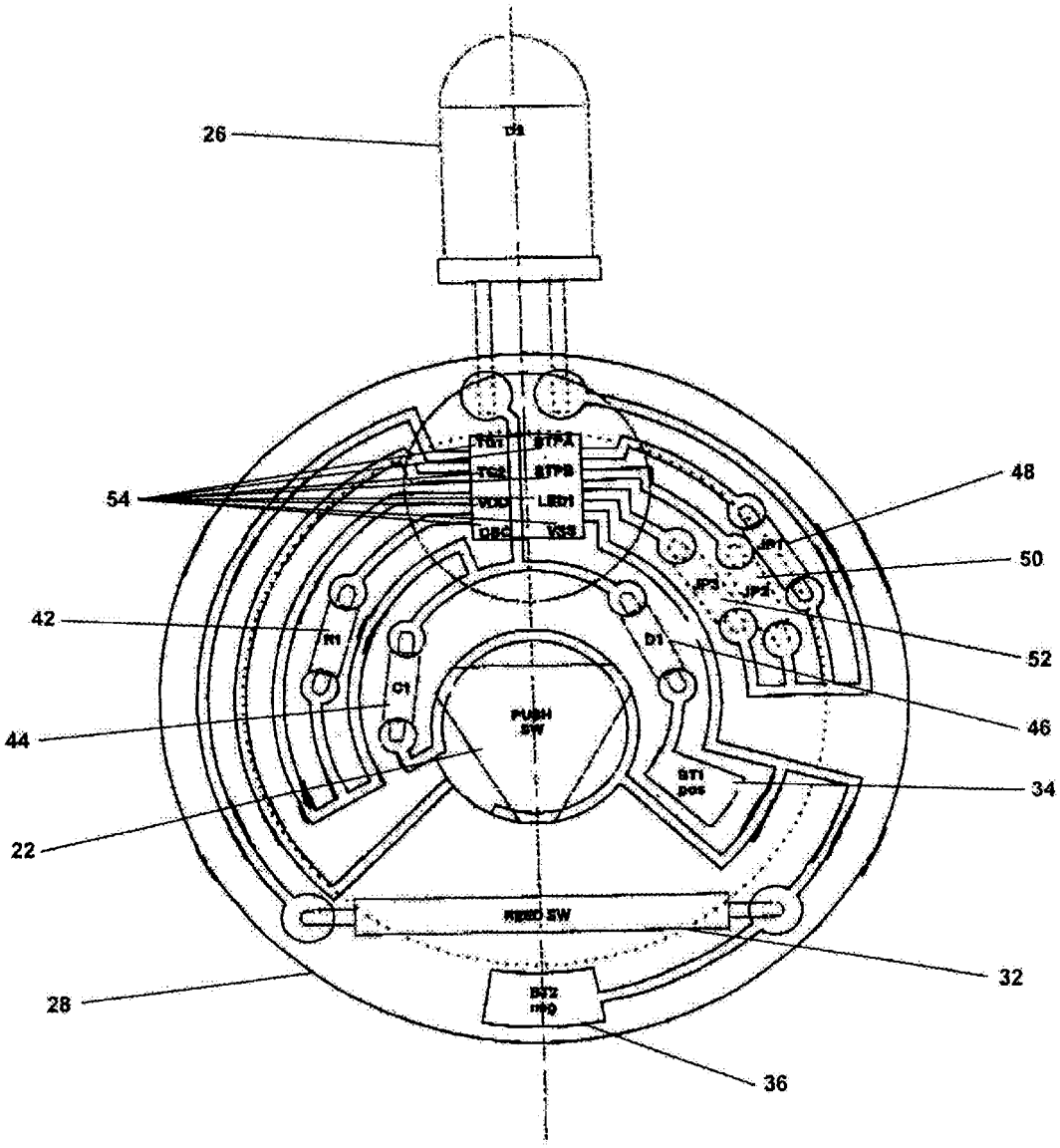
FIG. 1 is a top view of a modular lighting device and actuation system.

Turning now with more specificity to the drawings, wherein similar numerals depict like parts throughout, the numeral 100 generally depicting a modular lighting device and actuation system and the programmable control circuit for use within said device. As required, a detailed illustrative embodiment of the present invention is disclosed herein. However, illumination devices, programmable devices and methods for using such apparatus, in accordance with the present invention, may be embodied in a wide variety of forms and modes, some of which may be quite different from those in the disclosed embodiment, but are covered hereunder. Consequently, the specific structural and functional details disclosed herein are merely representative, yet in that regard, they are deemed to afford the best embodiment for purposes of disclosure and to provide a basis for the claims herein which define the scope of the present invention. To wit, device 100 is described, for purposes of illustration only, as employing a manual switch, switch means 22 and a sensor switch or sensing means 32 . The purpose for the illustrative example utilizing in essence two modalities to actuate or deactivate device 100 will become clear in the description set out below.

Known in the art is the use of a timing chips, like a 555 chip timer, as a chip means. With such a device the light would be activated and turned on, then after a predetermined period of time would shut itself off. While such a timer is suitable for some purposes, it lacks the requisite programming intelligence to perform competing logic commands and can malfunction. Therefore, a chip in accordance with a 555-type would simply seize upon its attempt to react to competing programming directions and cease functioning.

A use for the instant invention device 100 obtains to a modular handheld personal lighting device, and although other uses are set out hereinbelow, for illustrative purposes only, the instant invention will be described in terms of this use as it relates to a manual interaction between user and device 100. Device 100 is preferred to be of a modular nature, that is it can be used either alone as a lighting device or incorporated into an overall system.

FIGS. 1, 2, 3 and 4 depict a preferred embodiment of a programmable control circuit for use within an illumination device and said device 100 (hereinafter referred to as device 100). Device 100, in accordance with the aforementioned figures is fashioned as a small illumination device constructed from circuit board 28, upon which and integrated therewith reside power source 30 of FIG. 4, programmable chip means 20, a switch means 22 (like a mechanical push button) alone and in combination with a sensing means 32 (or in the alternative and described hereinbelow reed switch and also numbered 32), and a lighting means 26. Sensing means 32 and switch means 22 are adapted to effectively turn the lighting means 26 into an "on" or "off" condition. In addition, at least one of pins 54 which mount programmable chip means 20, may be used as an alternate embodiment with jumpers 48, 50 and 52, as in FIGS. 1 and 5 to elicit a variety of directions, subsets and different levels of illumination. Programmable chip means 20 continuously reads a programmed set of instructions, said program providing instructions such as that shown in FIG. 6, said programming language being any desired language and it should be understood herein that no claim is made to an exact programming language.

Figure 6:
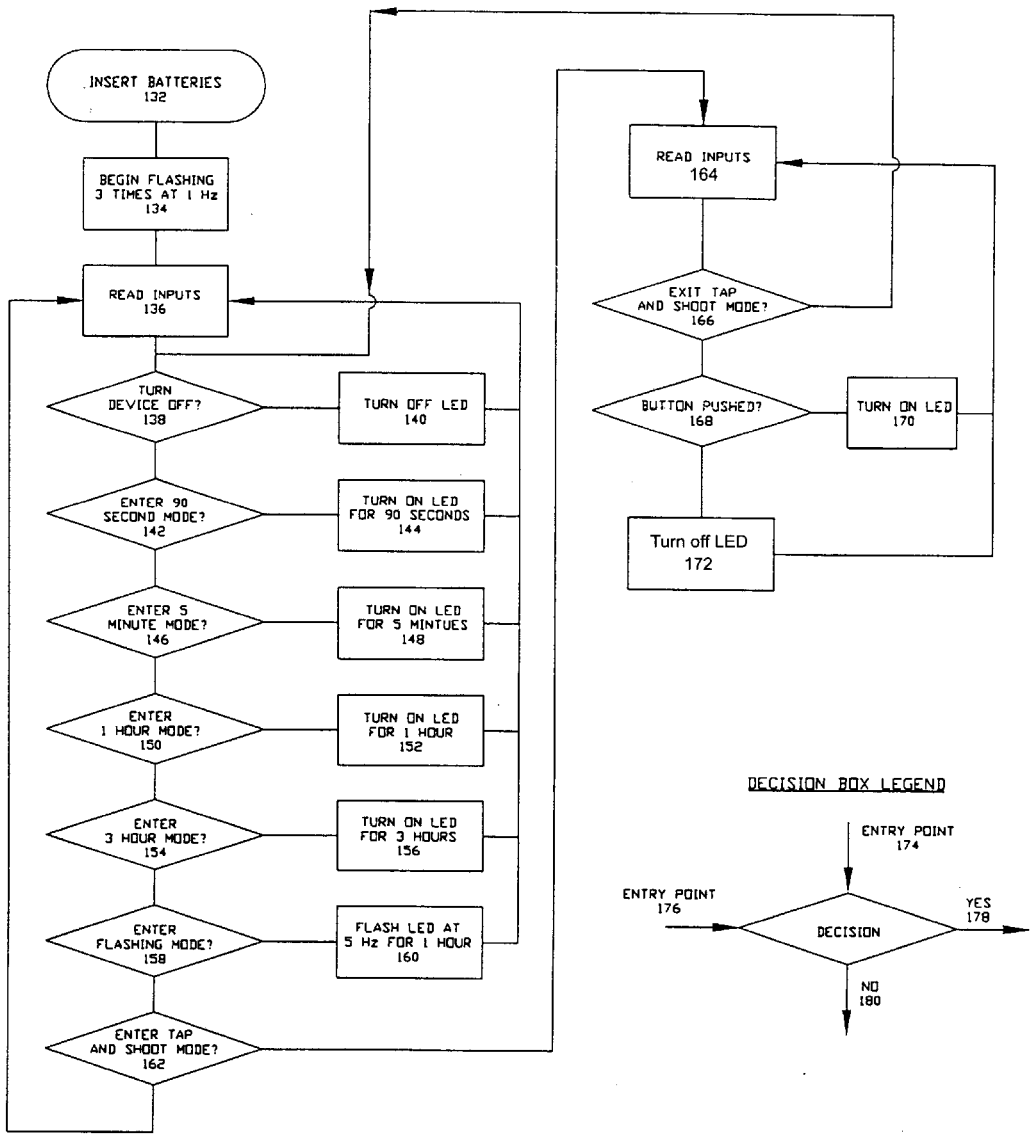
FIG. 6 is a flow chart depicting the circuit diagram of programmable control circuit for use within a modular lighting device and actuation system.

As a preferred embodiment in accordance with the instant invention, and illustrated by FIGS. 1 and 6 a timer or timing means not specifically illustrated other than being incorporated by reference into the chip means 20, which may be integral to programmable chip means 20, or may be external thereto is adapted through a series of programming steps that determine the state of the timing means, to turn device 100 into a powered down condition so that lighting means 26 is "off" after a programmed period of time elapses. It should be noted that device 100 is always in one of four modes (1) a sleep mode (minimum power); (2) an active "on" mode (maximum power); (3) a deactivated or "off" mode (no power); or (4) a variable power consumption mode. A timing means may be internal to programmable chip means 20 or external to chip means 20, and may be an oscillator, resonator, clock signal or the like. Said external oscillator or resonator chip or circuit must be capable of providing the requisite signals to programmable chip means 20.

Preferably, lighting means 26 is a light emitting diode (hereinafter LED) with either a diffused light or concentrated, angled light. In accordance with the various LEDs commercially available, the LED may be angled, diffused or combinations thereof. Alternately, the circuitry and embodiments may be applied to an incandescent lighting means.

Figure 4:
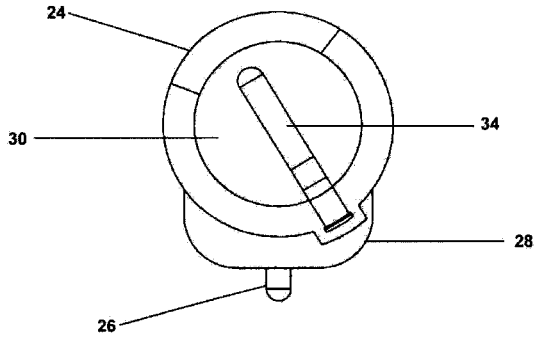
FIG. 4 is a bottom view thereof.

When the user depresses push button 22, power source 30, as shown in FIG. 4, supplies a greater amount of power (from sleep to power mode) to programmable chip 20. Said programmable chip 20 reads an inputted program in accordance with a programming embodiment of FIG. 6, which initiates a preferred actuation routine of lighting means 26. In this most basic design, device 100 may be inactivated (into an off condition) either by means of the program or a second actuation by the user of the mechanical switch. In addition, device 100, if used in accordance with a stimulus such as the magnetic field of a reed switch sensor, in order to deactivate device 100, in accordance with the programming protocol set out in FIG. 6, all the inputs are read and when a magnetic field is detected reed switch 32 is in the closed position, and power source 30 does not supply power to lighting means 26. Therefore, if device 100 is used in a closeable object like a purse, handbag, or drawer, as the device senses the oncoming magnetic field it will upon close physical association with that field turn the device into the off condition. Hence, on/off may be achieved by the interplay between program logic, manual manipulation and sensor reading. It should be noted that lighting means 26 may be connected directly to circuit board 28 or may be plugged into a light socket adapted therefore as a light holder (LED holder 40) which is attached to circuit board 28.

The mode in which device 100 illuminates an area is dictated by the program logic of programmable chip means 20. According to one embodiment, depressing push button 22 will cause lighting means 26 to be illuminated for a specified period of time, and then deactivated or "shut off". Another program may cause lighting means 26 to illuminate only when pressure is applied to push button 102. Still another programming embodiment would cause the light of lighting means 26 to blink intermittently when manually actuated.

Figure 2:
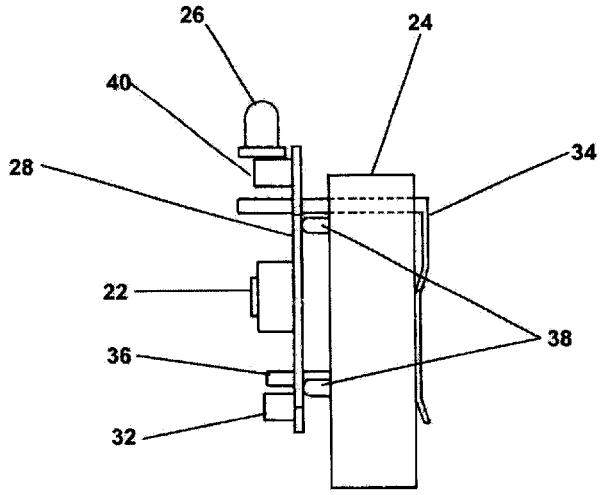
FIG. 2 is a side view thereof.

FIG. 2 illustrates the overall conformation of device 100 and particularly shows the placement of battery holder or battery retention means 24. In a preferred embodiment, the battery retention means may contain a battery clip, which includes a positive battery clip connector 34 and a negative battery clip connector 36, either affixed or integral to battery holder 24 and may include battery standoffs 39 to provide stability for battery holder 24. Battery holder 24, is in electrical and physical communication with circuit board 28 by battery clips 34 and 36, which provide contact and the delivery of direct current power to the circuit board.

Figure 3:
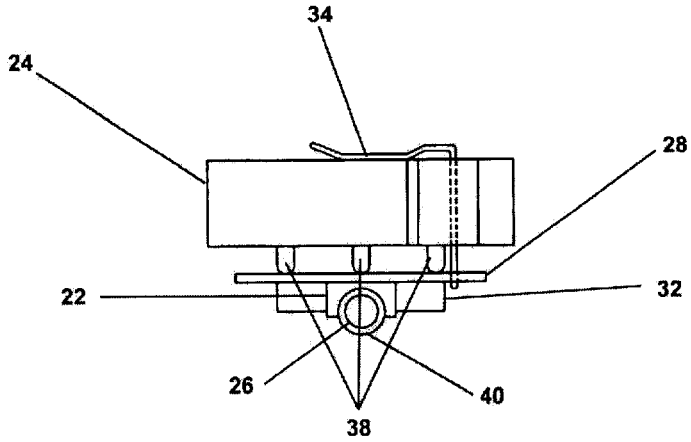
FIG. 3 is a front view thereof.

FIGS. 3 and 4 best portray power source as it is associated with device 100, showing the relative proportions when used with at least a watch-type battery. Other power sources like solar cells, atmospheric, radio frequency and kinetic mechanisms could be operatively substituted.

Figure 5:
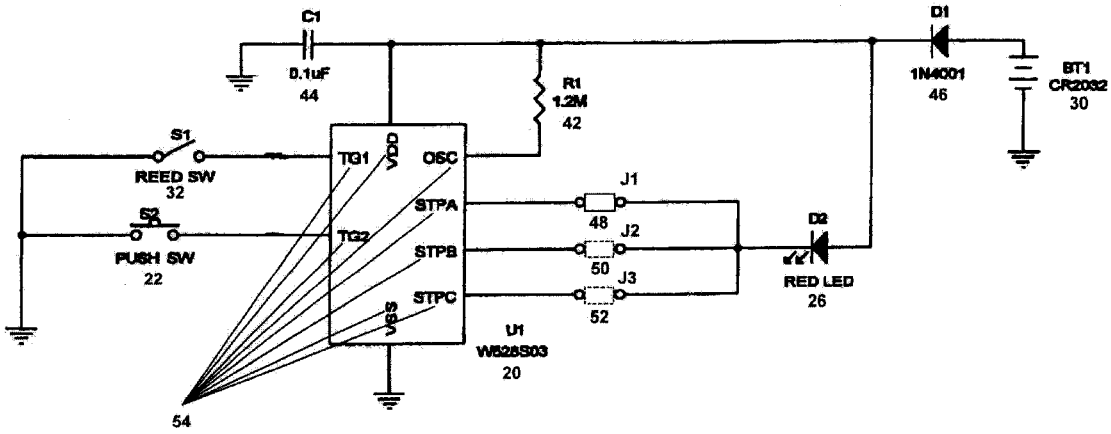
FIG. 5 is a circuit diagram thereof.

FIGS. 1 and 5 sets out a top plan and electrical diagrammatic view of the present invention, and depicts an alternate preferred embodiment of an electrical circuit according the present invention. As can be seen, there is a power source 30, having a positive terminal 34 and a negative terminal 36. From the positive terminal 34 current flows to a diode 46 which regulates the voltage from power source 30. Diode 46 may be surface mounted. Voltage from diode 46 flows to resistor 42, said resistor reducing the voltage to a preferred voltage so that programmable means 20 runs at a specified processor speed. Capacitor 44 stabilizes the voltage while processor/programmable means 20 determines the condition of switch means 32 and/or manual switch means 22. An oscillator, not specifically enumerated in the drawings, and which may be internal to programmable means 20 further governs processor speed while jumpers 48, 50 and 52, may further regulate current or enable different software steps so that lighting means 26 (LED) is illuminated for a specified duration of time.

Diode 46 is used to reduce the voltage to approximately 5 volts DC. In a preferred embodiment, a first resistor 42 is used to establish the oscillator speed of the programmable device. Pursuant to a preferred embodiment, a first capacitor 44 is used to stabilize the voltage supplied to the programmable chip means 20. Power source 30 supplies current to the apparatus, which through associated circuitry and programming determines whether to supply current to the lighting means 26. According to a preferred embodiment of the present invention power source 30 consists of two 3V type 2032 coin cell Lithium batteries at 200 mAh. Programmable means 20 constantly determines the state of reed switch 32 sensing means to detect the presence or absence of a magnetic field and also may determine the direction of movement of the magnet. That is, whether the magnet is coming towards the device or going away from the device, corresponding to actuating and deactivating conditions. Not only does programmable chip means 20 detect the state of reed switch sensing means 32 and performs certain actions depending on the current state of the device, but it also senses the position of the manual switch means 22 which may be programmed to override the reed switch sensing means.

According to a preferred embodiment of the present invention the illumination device discloses a sensing means, programmable chip means, lighting means and power source in operative communication with one another. Switch means 32, which may be a sensor, will detect the presence of any number of triggers to effect an "on" or "off" condition of lighting means 26. The trigger that actuates the sensing means to an "on" or "off" condition may be light, radio frequency, movement, sound, magnetic fields or any other detectable change in physical state. For example, a light sensitive sensing means actuates device 100 to an "on" or "off" condition according to the level of ambient illumination and/or the alteration of visible and non-visible light frequencies. Photo-resistors, photodiodes, phototransistors, and photosensitive semiconductors may be used as light-sensitive resistors whose resistance decreases with the amount of light falling on them yielding alternate photo-sensors. Photo-sensors use light to control current passing through them and act as variable resistors controlled by the amount of light. They are photoconductive in that their resistance decreases in proportion to the amount of light that shines on them.

Other sensing means or sensors may react to different external stimuli. In another preferred embodiment, for example, a motion detection sensor is adapted to detect and process any movement within a spatially-determined zone. A sound actuated sensing means may also be used, said sensor to react to sound, while radio frequency detectors react to specific radio frequencies. As a standard precept, all of the aforementioned sensors may be programmed to accept outside information relating to programmed parameters to trigger an effect and/or an "on" or "off" condition. In addition, level and proximity sensors may be operatively employed so that changes in physical tilt or intrusion will actuate device 100.

As a preferred embodiment of the instant invention, programmable chip means 20 may be adapted to implement a power management program, in order to conserve power or charge/recharge the system. For instance, the programmed instruction(s) will determine the time that the lighting means 26 (LED) will be energized and when said lighting means is to be "turned" into an off condition. Hence, the program instructs the device to automatically "shut off" after a predetermined length of time. Alternatively, if battery power is low an instruction to conserve power by limiting current flow to lighting means 26 will be effected. For example a signal to the user, shorter duration of illumination, or a dimming of the light evidences a programmable feature warning the user of a low power condition. It should be noted that the programming preferably utilizes non-floating point logic so that fewer steps are required to accomplish a given task. As a result less power is used even when the device is in a period of actuation. Previously, personal illumination devices (such as flashlights) lack a power management system, and therefore will drain quickly of sufficient power without informing the user.

In accordance with FIG. 1, programmable chip means 20 may be a microcontroller, programmable application specific integrated circuit, microprocessor, external or internal ROM chip, an external or internal RAM chip, and an I/O Port. In order to achieve the desired attributes of the present invention, the programming means should possess at least one clock with a clock speed of at least about 32 kHz, with a minimum of about 512 program bytes, and a voltage preferably about 1.5 volts to 12 volts. According to a preferred embodiment of the present invention a programmable application specific integrated circuit is used, such as an ADPCM voice synthesizer type W528S03 speech chip that is produced by Winbond, which utilizes the ADPCM coding method. Such a chip is a volatile, one-time programmable, non-erasable, randomized RAM chip, which, based on the dictates of the programmed logic, performs certain actions. In addition, the chip may internally possess an oscillator and a memory segment.

More specifically, the chip is preferably a CMOS (complementary metal oxide semiconductor) type chip. CMOS is a widely used type of semiconductor. CMOS semiconductors use both NMOS (negative polarity) and PMOS (positive polarity) circuits. Since only one of the circuit types is on at any given time, CMOS chips require less power than chips using just one type of transistor. This makes them particularly attractive for use in battery-powered devices.

While the initial preferred embodiment is an on/off condition mediated by the program logic a variety of other illumination durations may be operatively substituted. As described hereinbelow and pursuant to FIG. 6, the illumination period may be flashing, constant, or user defined as a number of flashes corresponding to beats per minute or a desired variable tempo expressed other than beats per minute.

Power means 30 preferably maintains a positive battery terminal 34 and a negative battery terminal 36.

As represented by FIGS. 1 and 5 jumpers 48, 50 and 52, may also be used initiate alternative modalities by triggering a programming protocol or effect an "on" or "off" condition through their presence. They are used for such things as differentially setting the CPU type and speed, interrupt levels, I/O addresses, and enabling or disabling certain features, including increasing and decreasing the voltage supplied to the lighting means or bypassing certain features. Jumpers 48, 50 and 52, which are displayed in FIGS. 1 and 5, as a plurality of jumpers 48, 50 and 52, can be actuated either manually or as a result of the programmed logic. As illustrated in FIGS. 1 and 5, jumpers 48, 50 and 52, reside in either an open (inactive) condition or closed (active) condition, often corresponding to the activation of a feature, or inactivation of a feature. An open condition (not actuated) is illustrated as dotted lines, while the closed condition (actuated) is shown as solid lines. For example, when a jumper is in the closed or thrown position, a further series of programming steps may be initiated resulting in an intermittent light, a more intense light, or a light of a different duration.

Programmable chip means 20 may be programmed using any appropriate programming language, and according to appropriate logic, as to allow for different periods of illumination according to different stimulus, e.g.—the condition of the sensing means. For example, by using the programming language (ie Assembler) one can program a desired illumination period or the mode of activation (manual or sensor).

As a preferred embodiment and in accordance with FIG. 6, the programming in accordance with the instant invention, is such that a multitude of different triggers may be utilized in one apparatus according to the programming commands hierarchy. Simply stated, and set out in FIG. 6, the programming logic shows the functionality of device 100 in response to a sensed stimulus. When a user inserts batteries 132, lighting means 26 begins flashing 134 to show that power is being supplied to device 100. Programmable chip means 20 reads all inputs 126 to insure that all connections are made and a circuit is complete. Depending on the programming direction, lighting means 26 is either turned from "on/off" to "off/on".

In order to achieve the desired attributes, in accordance with FIG. 6, a specific logic design is entered into the programming means using a schematic capture package or a hardware description language. The programmable device then proceeds, through an elaborate set of steps, to generate a list of transistors to turn on or any other method known in the art (e.g. anti-fuses, in order to cause a particular field programmable logic device to implement the user's design). According to a preferred embodiment utilizing said program, the program is written, compiled to a binary file, then chip programming hardware is used to program the programmable chip device according to the specifications of the binary file. Assembler language may be used to write a program according to the sensing means and the desired hierarchy. It may also be desirable for data masking to be utilized, which allows users to store secondary information about discrete and particle data. Secondary information may be stored as an array of ID's which are used to index into a list of "mask conditions" which can be used to indicate special conditions of data at individual points. The special conditions could be sensor errors, interrupted data collection, statistical or instrumental uncertainty or any other condition which should be stored with the data, without destroying the values. These mask conditions may be used to 'remove' any data points marked as a 'bad' value. Thus, mask conditions provide for more reliable programming and reduced errors.

FIG. 6 depicts a simplified flow chart showing an overall embodiment. Set out as Decision Box Legend, is the decision logic. To wit, the process starts at entry point 174 or entry point 176, and as the arrows so depict a yes/no decision is made. If the decision is a "yes" decision 178 an action takes place, whereas a no decision 180 evidences an alternate action. Simply, the logic in accordance herewith, reads the position of the mechanical switch 22 and then the condition of sensor 32 (reed switch 32). If either switch 22/32 is in an actuated position or switch means 32 perceives a change of state, lighting means 26 of device 100 will be illuminated for either a specific period of time or indefinitely. The logic will, either shut the device off, maintain the device on, or maintain the device in a specific embodiment (ie flashing, user actuated etc.).

Returning to the main logic diagram as set out in FIG. 6 and utilizing the decision logic as described hereinabove, a logic paradigm may be described. As shown, the batteries are inserted 132 and the light flashes three times 134. All inputs are read 136, which is to say that device 100 is readied by reading all modes which may be enabled including all connections which must be made. For example, the presence or absence of a jumper is detected, and the status of a sensing means (e.g. reed switch, motion detector) and/or switch means is read so that the system is readied. If a reed switch is utilized, an open or closed state, corresponding to a lighted or unlighted condition is ascertained. For purposes of illustration, this description is provided with regard to a manual push button switch and a reed switch (magnetic sensor); so device 100 will read the condition of the sensor (reed switch) and the position of the push button.

An overview in accordance with FIGS. 1 and 6 militates to the following: (1) the device continually reads all inputs (conditions); (2) and based on reacting to the aforementioned conditions lighting means 26 in accordance with device 100 is either turned on, off, no action is taken (on/off condition remains); (3) the condition is interpreted in light of the programming directions and all inputs are continually read; and (4) the lighting means 26 in accordance with device 100 is activated, deactivated or remains in the same condition.

In accordance with the preferred description elucidated herein and FIGS. 1–5, depicting a dual switch embodiment, a decision to turn off the device 138 is made, and if such a command is programmed the LED will be turned off 140 or if the decision is made not to turn the LED off, then a second decision which corresponds to magnetic actuation of the device and a lighting period of ninety seconds is made 142 and the decision is enabled by turning the LED on for ninety seconds 144, said input being interpreted by read inputs 136.

Other decisions which correspond to time periods may be effected by a similar method. For example if the ninety second period of 144 is not chosen (a no decision 142), then a five minute 146, a one hour 150, or a three hour 154 decision may be chosen, or by holding the button in a depressed condition a momentary flashing light is elicited 160 from decision 158. In another embodiment not set out depressing the push button will simply override the sensor and result in continuous "on" condition of the LED.

According to FIGS. 1 and 6, by using at least one jumper means as described herein, in a closed condition a decision to enter a user actuated mode 162 is enabled. If the decision to enter such a mode is made then all inputs for this mode are read 164 and a decision whether to remain in or exit the existent mode made 164. Decision 168 is entered and the LED (lighting means 26), is either turned on 170 or off 172 based on the status of switching means 22 as detected in 164. The apparatus will react according to the logic programmed to enter into the appropriate mode. According to the embodiment depicted, if certain requirements are met e.g. the push button is depressed, light is sensed, etc. a programmed output will occur. For instance, if three taps (depressing the manual switch three times) corresponds to that programmed decision for turning device off 138, the logic will dictate that the LED will be turned off 140. The program may read inputs and enter 90 second mode decision 142, and accordingly turn on LED for 90 seconds 144. Similarly, 5 minute mode decision 146 illuminates the LED (lighting means 26) for 5 minutes 148, then shuts it off, unless another sensing means according to the logic dictates another action. Also, the logic may react to stimulus to effectuate entering into 1 hour mode 152, 3 hour mode 156, turn on LED for 3 hours 156, flashing mode 160, or a user defined momentary actuation illumination mode 160 or flashing user mode 160. A user defined illumination mode (yes decision) 162 dictates that the inputs are read 164, and the LED reacts immediately to the push button. If the certain logic is met, a user illumination mode will be exited from 166. Otherwise, when manual switch (switch means 22) is checked and found to be depressed 168, the light is illuminated 170 or the LED is turned off 172. A number of different sensing means may be used, as well as any desired hierarchical structure. For instance, a depressed push button may override 1 hour mode, or motion sensed, or actuated reed switch. Because of the nature of the programming logic, the programmable means is intelligent enough to know when light is desired and shut itself off when not needed. When not utilized, the apparatus goes into shut down mode and requires very little power. It may also be desired to provide for an indication when the battery level is starting to reach low levels. For instance, the light may flash when low power levels are detected. Also, the logic may dictate that the period of actuation may be decreased when the power level is low.

The lighting means may be a light emitting diode (LED), which is clear, frosted (diffused) and emits light in angles from 1 degree to 360 degrees, an incandescent light bulb or any other lighting means known in the art alone or in combination. The lighting means according to a preferred embodiment is a multidirectional light emitting diode with an angled light of from 25 degrees to 180 degrees, such as that commercially produced by Hiyoshi Electric Co., Ltd. Such a light emits light in all directions, is non-fragile, durable and emits little to no heat.

The apparatus may also contain a programmable communication means such as a RFID device, receiver, transceiver and transmitter. A receiver, transceiver and transmitter may all be used as parts within the apparatus to perform different functions. A receiver may receive digital or analog signals. The transmitter may transmit digital or analog signals and a transceiver, which is short for transmitter-receiver, both transmits and receives analog or digital signals. RFID (Radio Frequency Identification) may be used as an automatic identification technology. The simplest form of radio frequency identification device (hereinafter RFID) is typified by an electronic bar code, while more sophisticated RFID products can interface with analog and digital sensors. RFID systems are composed from three components 1) an interrogator or reader, 2) a transponder, commonly called a tag, and 3) a control and data processing computer. The RFID reader has electronic components that send and receive a signal to and from a tag (ie its own chip means), a programmable chip means 20 could check and decode the data, and memory chip could store data. The reader is connected to an antenna for transmitting and receiving signals. The reader can be part of control and data processing computer or housed remotely. These devices may be in communication with the other components, particularly a programmable chip means. This is useful for a number of different purposes, for instance, it may be used to identify the lighting apparatus and a user.

Also, external components may be used to implement rudimentary logic in combination with any number of other logic devices or on their own. For instance, a capacitor may be used to stabilize the voltage supply. This is useful because some programmable means react undesirably to voltage (for instance if the trigger was accidentally activated or jarred) and a capacitor would stabilize the power supply and make sure that the programmable means does not malfunction. Capacitors may also be used to retain information between a device shut down and restart. For instance, it may be desirable to completely shut down the system in order to conserve power. However, because the device is programmed to act a certain way upon powering up you may want the apparatus to act as though the light has been on the entire time and not to react as though it is starting for the first time. A capacitor would allow the system to shut down to conserve power, yet not cause the programmed logic to return to the beginning.

An oscillator or other clock cycle generator, which is not specifically depicted in the drawings, except as it is incorporated by reference herein and which may be operatively substituted by a resonator), which may be integral to programmable chip means 20, may be interposed to provide added accuracy to the timing of the circuit. A transistor may be used to allow more power to be delivered to the light and provide better illumination. Other external components may be used in accordance with the present invention in order to achieve desired lighting effects or qualities.

Device 100 preferably has a memory segment, said memory segment may have an internal or external chip with read only memory (ROM), random access memory (RAM), which is read-write capable and an input/output port. The input/output port is programmed to input (weak pull-up or tri-state (Hi-z)) and output. In Hi-z mode the device may be used to impede current flow in a circuit or detect outside conditions. Hi-z input is usually used if voltage being supplied is external to the chip and usually requires a resistor going to ground. In weak pull-up mode the input port may be used to detect outside conditions (e.g. button being pushed, motion, etc.). In this sense, when the input port is set to weak pull-up it may act as a sensing means.

When set to output mode the device is used to drive external devices in the circuit. The port, when in output mode, may be set to zero (low) or one (high). When set at one, electricity flows directly through and drives an external device. Setting a pin to output zero, sets it as a sink and essentially connects it to ground. In a preferred embodiment according to the present invention the input port of the sensing device (e.g. reed switch) is set to weak pull-up and then the pin is read to determine if the sensing means is actuated or non-actuated. If the sensing means is actuated, the programming means determines the state of the pin and acts in accordance with the logic programmed.

It is a purpose of the present invention to be used within a personal effects container as for example a purse or a knapsack. The apparatus should be placed in a holder or receptacle such as a pouch, and the pouch attached to the inside of the personal effects container. It is a purpose to provide that the apparatus and its holder or receptacle may be removable, such that the apparatus may be used to provide illumination within the personal effects container or be removed to provide illumination in any desired area.

The following is intended to represent an example of possible parts that may be utilized according to a preferred embodiment. It should be understood, though, that other commercially available parts may be equivalently used.

EXAMPLE

Set out below is a preferred series of parts for the device:

1. A printed Circuit Board.
2. ADPCM voice synthesizer type W528S03 speech chip.
3. A 0.01 $\mu$fd capacitor.
4. Meder Reed Switch Part. No. MK15-B-2.
5. MPD Battery Holder BH 1000-G-ND.
6. CR-3032 Battery.
7. E-switch Push Button TL3301N26OQG.
8. 3 mm multidirectional light commercially produced by Hiyoshi Electric Co., Ltd.
9. 3 jumpers.
10. A low power diode IN914.
11. A 1.2 Meg Ohms resistor which establishes 3 Mhz clock speed on speech chip.

These and other objects, advantages, features and aspects of the present invention will become apparent as the following description proceeds. While the foregoing embodiments of the invention have been set forth in considerable detail for the purposes of making a complete disclosure of the invention, it will be apparent to those of skill in the art that numerous changes may be made in such details without departing from the spirit and the principles of the invention.

We claim:

1. A modular lighting device and actuation system comprised of:

a portable housing, configured and dimensioned to be held within a user's hand, thereby allowing the modular lighting device to be used as a portable accessory;

a button contained within the portable housing and having an exposed portion of the button extending through the housing, with the exposed portion of the button being capable of being selectively pressed by the user;

a sensing means contained within the portable housing;

a programmable chip contained within the portable housing in operative communication with the sensing means, and responsive to an externally-actuated mode-selection input by the user pressing the exposed portion of the button to determine a selected mode for altering a program flow of the programmable chip, said programmable chip programmed to activate or deactivate in accordance with the selected mode;

a light source contained within the portable housing; and a power source contained within the portable housing and electrically connected to said programmable chip and to said light source.

2. A modular lighting device and actuation system as in claim 1, wherein said programmable chip means includes means for generating, storing and outputting information selected from the group consisting of a controller, microcontroller, microprocessor, programmable application specific integrated circuit, external or internal ROM chip, an external or internal RAM chip, and an I/O port and combinations thereof.

3. A modular lighting device and actuation system as in claim 1, wherein said lighting means is selected from the group consisting of a light emitting diode, multidirectional light emitting diode, an incandescent bulb and combinations thereof.

4. A modular lighting device and actuation system as in claim 1, further comprising a programmable communication means selected from the group consisting of an RFID Devices, receiver, transceiver, transmitter and combinations thereof.

5. A modular lighting device and actuation system as in claim 1, wherein said sensing means is selected from the group consisting of a reed switch, pressure switch, hall-effect switch, photo transistor, photo-resistor, photodiode, photosensitive semiconductor, motion detector, sound frequency detector, radio frequency detector level switch, proximity switch and combinations thereof.

6. A modular lighting device and actuation system comprised of:

a portable housing, configured and dimensioned to be held within a user's hand, thereby allowing the modular lighting device to be used as a portable accessory;

a button contained within the portable housing and having an exposed portion of the button extending through the housing, with the exposed portion of the button being capable of being selectively pressed by the user;

a sensing means contained within the portable housing a programmable chip contained within the portable housing in operative communication with the sensing means, and responsive to an externally-actuated mode-selection input by the user pressing the exposed portion of the button to determine a selected mode for altering a program flow of the programmable chip, said programmable chip programmed to activate or deactivate in accordance with the selected mode;

a light source contained within the portable housing;

a power source contained within the portable housing and electrically connected to said programmable chip and to said light source;

a switch means having an actuated and non-actuated position; and at least one jumper.

7. A modular lighting device and actuation system as in claim 6, wherein said programmable chip means includes means for generating, storing and outputting information selected from the group consisting of a microcontroller, microprocessor, Programmable Application Specific Integrated circuit, external or internal ROM chip, an external or internal RAM chip, an I/O port, and combinations thereof.

8. A modular lighting device and actuation system as in claim 6, wherein said lighting means is selected from the group consisting of an light emitting diode, multidirectional light emitting diode, an incandescent bulb and combinations thereof.

9. A modular lighting device and actuation system as in claim 6, further comprising a programmable communication means selected from the group consisting of an radio frequency identification devices, receiver, transceiver, transmitter, and combinations thereof.

10. A modular lighting device and actuation system as in claim 6, wherein said sensing means is selected from the group consisting of a reed switch, pressure switch, hall-effect switch, photo transistor, photo-resistor, photodiode, photosensitive semiconductor, motion detector, sound frequency detector, radio frequency detector level switch, proximity switch and combinations thereof.

11. A modular lighting device and actuation system comprised of:

a portable housing, configured and dimensioned to be held within a user's hand, thereby allowing the modular lighting device to be used as a portable accessory;

a button contained within the portable housing and having an exposed portion of the button extending through the housing, with the exposed portion of the button being capable of being selectively pressed by the user;

sensing means contained within the portable housing;

a programmable chip contained within the portable housing in operative communication with the sensing means, and responsive to an externally-actuated mode-selection input by the user pressing the exposed portion of the button to determine a selected mode for altering a program flow of the programmable chip, said programmable chip programmed to activate or deactivate in accordance with the selected mode;

a light source contained within the portable housing;

a power source contained within the portable housing and electrically connected to said programmable chip and to said light source;

a switch means having an actuated and non-actuated position;

at least one jumper; and at least one resistor, capacitor and oscillator effective to control voltage and processor speed.

12. A modular lighting device and actuation system as in claim 11, wherein said programmable chip means includes means for generating, storing and outputting information selected from the group consisting of a microcontroller, controller, microprocessor, Programmable Application Specific Integrated circuit, external or internal ROM chip, an external or internal RAM chip, an I/O port and combinations thereof.

13. A modular lighting device and actuation system as in claim 11, wherein said lighting means is selected from the group consisting of an light emitting diode, multidirectional light emitting diode, an incandescent bulb and combinations thereof.

14. A modular lighting device and actuation system as in claim 11, further comprising a programmable communication means selected from the group consisting of an RFID Devices, receiver, transceiver, transmitter and combinations thereof.

15. A modular lighting device and actuation system as in claim 11, wherein said sensing means is selected from the group consisting of a reed switch, pressure switch, hall-effect switch, photo transistor, photoresistor, photodiode, photosensitive semiconductor, motion detector, sound frequency detector, radio frequency detector or combinations thereof.

16. A modular lighting device and actuation system comprised of:

a portable housing, configured and dimensioned to be held within a user's hand, thereby allowing the modular lighting device to be used as a portable accessory;

a button contained within the portable housing and having an exposed portion of the button extending through the housing, with the exposed portion of the button being capable of being selectively pressed by the user;

a sensing means contained within the portable housing;

a programmable chip contained within the portable housing in operative communication with the sensing means, and responsive to an externally-actuated mode-selection input by the user pressing the exposed portion of the button to determine a selected mode for altering a program flow of the programmable chip, said programmable chip programmed to activate or deactivate in accordance with the selected mode;

a light source contained within the portable housing;

a power source contained within the portable housing and electrically connected to said programmable chip and to said light source;

a switch means having an actuated and non-actuated position;

a plurality of jumpers effective to control current or effectuate alternate programming direction; and at least on resistor, capacitor and oscillator effective to control voltage and processor speed.

17. A modular lighting device and actuation system as in claim 16, wherein said programmable device consists of parts selected from the group consisting of a microcontroller, controller, microprocessor, a speech chip, application specific integrated circuit, external or internal ROM chip, an external or internal RAM chip, an I/O port and combinations thereof.

18. A modular lighting device and actuation system as in claim 16, wherein said lighting means is selected from the group consisting of at least one light emitting diode, an incandescent bulb and combinations thereof.

19. A modular lighting device and actuation system as in claim 16, further comprising a programmable communication means selected from the group consisting of an RFID Devices, transceiver, transmitter and combinations thereof.

20. A modular lighting device and actuation system as in claim 11, wherein said sensing means is selected from the group consisting of a reed switch, pressure switch, hall-effect switch, photo transistor, photo-resistor, photodiode, photosensitive semiconductor, motion detector, sound frequency detector, radio frequency detector level switch, proximity switch and combinations thereof.

21. A modular lighting device and actuation system as in claim 1 wherein said apparatus is modular.

* * * * *